US005503302A

United States Patent [19]

DeJonge

[11] Patent Number: 5,503,302

[45] Date of Patent: Apr. 2, 1996

[54] SEALED CONTAINER PUNCTURER AND SPRAY DISPENSING DEVICE

[75] Inventor: Stuart W. DeJonge, Easton, Pa.

[73] Assignee: Primary Delivery Systems, Inc., Easton, Pa.

[21] Appl. No.: 377,922

[22] Filed: Jan. 25, 1995

[51] Int. Cl.[6] ..... B67D 5/00

[52] U.S. Cl. ..... 222/82; 222/83; 222/321.7; 222/325; 222/153.13

[58] Field of Search ..... 222/82, 83, 183, 222/153.07, 323, 324, 321.6–321.9, 382, 182, 153.13

[56] References Cited

U.S. PATENT DOCUMENTS

| | | | |
|---|---|---|---|
| 3,481,676 | 12/1969 | Schwartzman | 401/134 |
| 3,482,920 | 12/1969 | Schwartzman | 401/132 |
| 4,722,449 | 2/1988 | Dubach | 215/235 |
| 4,747,719 | 5/1988 | Parkin | 401/132 |
| 4,784,506 | 11/1988 | Koreska et al. | 401/132 |
| 5,328,055 | 7/1994 | Battle | 222/325 |
| 5,335,824 | 8/1994 | Weinstein | 222/82 |
| 5,364,386 | 11/1994 | Fukuoka et al. | 222/83 |
| 5,433,343 | 7/1995 | Moshberg | 222/82 |

*Primary Examiner*—Andres Kashnikow
*Assistant Examiner*—Philippe Derakshani
*Attorney, Agent, or Firm*—Kenneth P. Glynn

[57] ABSTRACT

The present invention is a spray dispenser device for receiving, puncturing and spray dispensing liquid from a sealed container. It includes an upper housing having a top, bottom, side walls, top opening, bottom opening and a vertical central axis of rotation. The top opening is for receiving and holding a spray mechanism, e.g. a pump, and the bottom opening is for a dip tube and piercing element. A lower housing is rotatably connected to and below the upper housing. It has a top, a bottom and side walls and has at least one top orifice. It is adapted to receive a container having a puncturable top seal. A container is placed within the bottom of the lower housing; the upper housing and lower housing are rotated relative to one another from a first position wherein the dip tube and piercing element are located away from the bottom of the lower housing, to a second position wherein they are closer to the bottom of the lower housing, the piercing element punctures the puncturable top seal and the dip tube enters the container through the puncture, for subsequent spray dispensing therefrom.

18 Claims, 1 Drawing Sheet

SEALED CONTAINER PUNCTURER AND SPRAY DISPENSING DEVICE

BACKGROUND OF THE INVENTION

1. Field of the Invention

The present invention is directed to a spray dispensing device with a sealed container opening mechanism, i.e. a seal puncturer. More specifically, the present invention is directed to a device which constitutes a spray dispenser and a puncturer which is used to receive a sealed container, puncture the container and provide for spraying for subsequent application. In general, the device of the present invention may be used for any type of liquid spray dispensing, such as bug repellant, sun screen, topical medication, surgical scrub, chemical testing, etc.

2. Information Disclosure Statement

The ability to pierce or break or otherwise enter into an ampoule or container of solution at the time of its use enables a user to avoid evaporation, clogging and other applicator type dispensers. Thus, numerous devices have been developed for puncturing a subcontainer or ampoule with an applicator at the time of the first use. For example, U.S. Pat. No. 3,481,676, issued to Schwartzman on Dec. 2, 1969 shows a system for piercing a subcontainer located within an applicator at the time of use by having an outer container with a series of bellows to enable the user to contract the container in such a way that a circular knife edge cuts into the inside container.

U.S. Pat. No. 4,747,719 to Parken describes a disposable topical application swab in which liquid which is initially stored within a tube or ampoule is pierced with a lance which is connected to the inside of an outer tube. In this case, the cap of the outer tube holds the swab applicator and when the cap is removed, the punctured ampoule and swab absorbent material is available for use. The cap in this prior art teaching has a first position and a second position, one for storing the inner tube in an unpierced position and the second for storage and piercing.

U.S. Pat, No. 4,784,506 issued to Koreska et. al. on Nov. 15, 1988, describes a device for applying a predetermined quantity of a liquid to a surface and involves the use of an applicator or swab as well as breakable ampoule.

There are two flexible blades located along the sides so that the outer container may be squeezed so as to pierce the ampoule and allow the liquid to then flow to the swab end of the device.

U.S. Pat. No. 3,482,920 to Schwartzman issued on Dec. 9, 1969 shows a swab type or blotter type applicator container wherein a sealed container of liquid is pierced at the time of use by depressing a cap which contains a piercing element which passes through the resilient material and breaks the end of the previously sealed container. When the cap is removed the applicator has liquid flowing in a free flow fashion to the absorbent material.

U.S. Pat. No. 4,722,449 issued to Dubach on Feb. 2, 1988 describes a container with a flip cap which includes a strip section on the cap which is removed and then the cap is pushed down so as to cause an orifice in the cap to pierce an otherwise sealed container to free liquid. While this patent shows multiple positions for the cap, it does not involve the use of the mechanism shown and claimed herein.

Notwithstanding the above cited prior art, the technology is lacking for a spray dispenser applicator which may puncture a sealed container and lock in the sprayer for subsequent spraying. Thus, the prior art neither teaches nor renders obvious the sealed container puncturer and spray dispenser device of the present invention.

SUMMARY OF THE INVENTION

The present invention is a spray dispenser device for receiving, puncturing and spray dispensing liquid from a sealed container. It includes an upper housing having a top, a bottom and side walls and has a top opening and a bottom opening, and a vertical central axis of rotation. The top opening is for receiving and holding a spray mechanism, e.g. a pump, and the bottom opening is for a spray mechanism dip tube and piercing element. There is also a lower housing rotatably connected to and below the upper housing. It has a top, a bottom and side walls and has at least one top orifice. It is adapted to receive a container having a puncturable top seal. When a container having a puncturable top seal is placed within the bottom of the lower housing and the upper housing and lower housing are rotated relative to one another from a first position to a second position, the first position being wherein the dip tube and piercing element are located away from the bottom of the lower housing, and the second position being wherein they are closer to the bottom of the lower housing, the piercing element punctures the puncturable top seal and the dip tube enters the puncture into the container, for spray dispensing therefrom.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

The present invention sprayer dispenser device is directed to a simplified way of utilizing spray medications maintained in puncturable sealed containers, e.g. liquids which may be sprayed but which must be maintained in an oxygen-free environment (i.e. enclosed in a sealed container) until it is ready for use. Thus, it is an object of the present invention to provide a self-contained device which constitutes a system for receiving a container of medicine, for rotating the device so as to puncture the container in a secured fashion, to relocate a spray device dip tube into the container, and to subsequently permit use of the spray mechanism for immediate use. Thus, the present invention will enable a user to insert a sealed container and to utilize same and subsequently dispose of it. In one embodiment, it is presumed that the present invention device and punctured container will be shipped together by the manufacturer or supplier of the medication, and the container and the device will be disposable and discarded together. In an alternative embodiment for controlled environment situations, such as for laboratory purposes, the present invention device may be arranged so that the upper and lower housing are removably connected so that they may be rotated back to a start position, separated and the container removed and disposed of, with the device otherwise being sterilized and reused.

Figure 1:
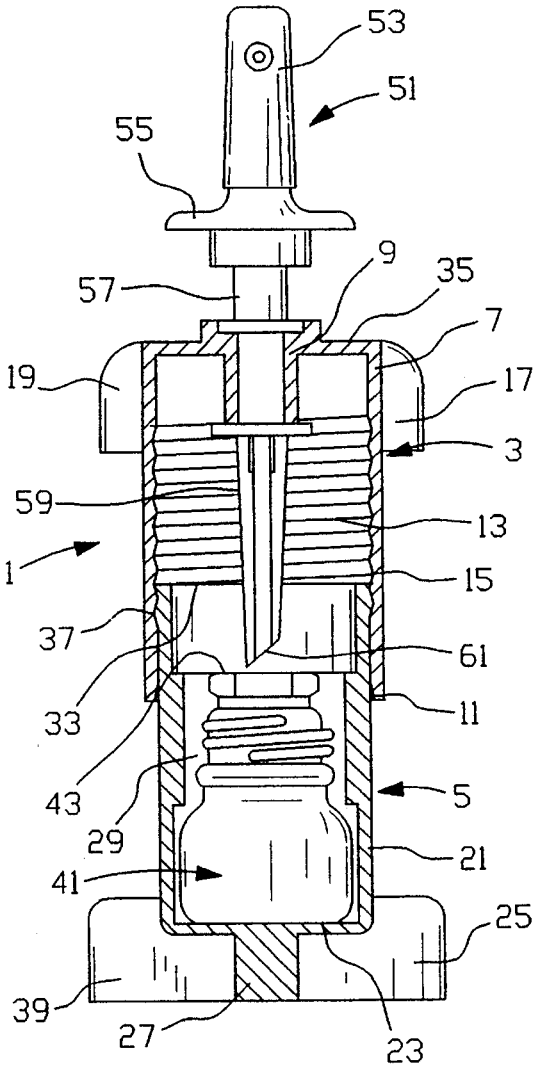
FIG. 1 shows a front cut view of a present invention spray device with a spray pumping mechanism inserted; and, FIG. 2 shows a front cut view of an alternative embodiment present invention device with an overcap and with a pull tab on the spray mechanism.

Referring now to FIG. 1, there is shown a first preferred embodiment present invention spray dispensing device 1 having an upper housing 3 and a lower housing 5, as shown.

Upper housing 3 has a top 35 and a bottom 11, as well as a side wall 7. There is a top opening 9 located in top 35 and bottom 11 is open. Open bottom 11 is in direct alignment with top opening 33 of lower housing 5, and creates a passage therethrough for a spray mechanism, a dip tube and piercing (puncturing) means. There is a spray mechanism 51 which passes through top opening 9, as shown in its upward position. Spray mechanism 51 includes a top 53, a finger flange 55, a pump housing 57, a dip tube 59 and a stiff ended dip tube/piercing means 61. (This puncturing mechanism (means 61) could be a separate piercing rod or cutter, but is most economically formed as part of the dip tube, as shown.) The dip tube/piercing means 61 extends downwardly into the lower housing 7.

Upper housing 3 includes threads 13 on its inside, and these are complimentary with thread 37 on the outside of lower housing 5 sidewall 21. Upper housing 3 also includes gripping flanges 17 and 19, and lower housing 5 has a solid bottom 23 with a downwardly extending pod 27 with gripping flanges 25 and 39. Open area 29 of lower housing 5 is adapted to receive and loosely hold a puncturable top sealed container such as medicine container 41.

There is a vertical central axis of rotation between the upper housing 3 and lower housing 5.

A user, e.g. a manufacturer or distributor, would insert container 41 into the open area 29 of lower housing 5 and snap upper housing 3 with spray mechanism 51 onto the lower housing 5, as shown. The device I and the container 41 may then be shipped to a doctor, pharmacist or other user or intermediary to the user. The user would rotate the upper housing 3 relative to lower housing 5 to screw them together, causing piercing means 61 to puncture the top 43 of container 41 and to drive the dip tube 59 downwardly so that the dip tube 59 is lowered into the container 41, e.g. down to or close to its bottom. Subsequently, the user would simply activate the spray mechanism 51 by pumping to utilize the spray medicine, as needed. The device 1 could be reusable or disposable, and the thickness, durability and other aspects of the spray mechanism will be designed accordingly. Also, changes could be made without affecting the function, e.g. the upper housing could fit into the lower housing instead of outside of it and the threading would be reversed (on the inside of the lower housing and the outside of the upper housing). Also, the spray mechanism could have an atomizer instead of a reciprocal pump.

Figure 2:
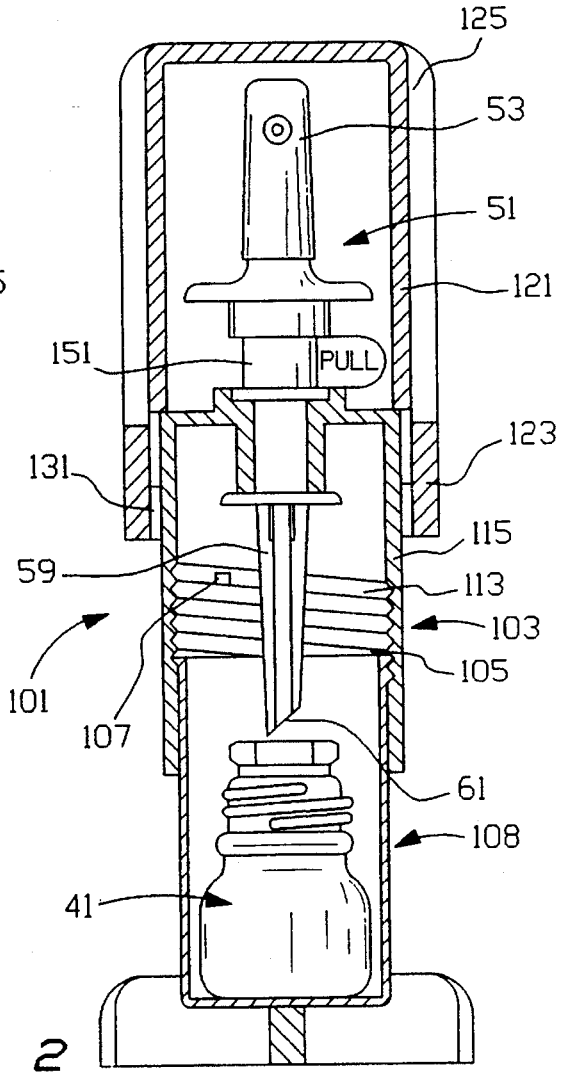

FIG. 2 shows a front cut view of a present invention device 101 which is very similar to device I in many ways, but includes some additional features. Parts which are identical to those shown in FIG. 1 are identically numbered. Here, upper/housing 103 has threads 113 which include stops 105 and 107. These would correspond to similar stops on the threading of lower housing 108, not visible in the Figure. Additionally, side wall 115 would have protrusions such as protrusion 123 and these are for interlocking with protrusions such as protrusion 131 of overcap 121 (optional grips 125 are also included). The stops aid in maintaining upper housing 103 and lower housing 108 in the first position (as shown) and then in the second position (with dip tube 59 in side container 41).

There is also a tamper evident pull tab 151 which must be removed in order to render spray mechanism 51 operable. Once the overcap 121 has been removed and the pull tab 151 has been removed and the rotation mentioned in conjunction with FIG. 1 has been accomplished, the user may then operate the device 101 for activating spray mechanism 51.

Obviously, numerous modifications and variations of the present invention are possible in light of the above teachings. It is therefore understood that within the scope of the appended claims, the invention may be practiced otherwise than as specifically described herein.

What is claimed is:

1. A combination sealed container puncturer and spray dispenser device for receiving, puncturing and spray dispensing liquid from a sealed container, which comprises:

(a) an upper housing having a top, a bottom and side walls and having a top opening and a bottom opening, and having a vertical central axis of rotation, said top opening and said bottom opening being in vertical alignment so as to create a spray mechanism passage through said top opening of said upper housing for receiving a spray mechanism, said bottom opening of said upper housing further having sufficient opening to receive a spray mechanism dip tube and a puncturing means, said sidewalls of said upper housing having threads thereon for attachment to and vertical screwing together with a lower housing;

(b) a lower housing rotatably connected to and below said upper housing, said lower housing having a top, a bottom and sidewalls and having a top orifice, and being adapted to receive a container having a puncturable top seal, said sidewalls having threads thereon which are complementary to and functionally connected to said threads of said upper housing; and, (c) a spray mechanism located within said top opening of said upper housing extending downwardly therefrom, a dip tube connected to said spray mechanism and extending downwardly therefrom and puncturing means connected to at least one of said upper housing, said spray mechanism and said dip tube;

whereby said upper housing and lower housing are adapted to be rotated relative to one another from first position to a second position, said first position being wherein said dip tube and puncturing means are located at first distances from the bottom of said lower housing, and said second position being wherein said dip tube and puncturing means are located at second distance from the bottom of said lower housing and close thereto than said first distances, such that a user may insert a container with a puncturable top seal, connect said upper housing at said lower housing in said first position, and subsequently, while said device is in its first position, rotate said upper and lower housings relative to one another so as to puncture said top seal of said container and so as to insert the dip tube of said spray mechanism into said container for spray dispensing.

2. The device of claim 1 further including a spray mechanism pull tab collar inserted onto said pump mechanism so as to incapacitate said spray mechanism until it is removed therefrom.

3. The device of claim 1, wherein said upper lower housings include external gripping means.

4. The device of claim 1, wherein said spray mechanism is a pump.

5. The device of claim 1 further including stops located on said threads of said upper housing and said lower housing, said stops being positioned so as to maintain said upper housing and said lower housing and having a predetermined force threshold necessary to be overcome to permit rotation of said upper housing relative to said lower housing from said first position to said second position.

6. The device of claim 2 further including stops located on said threads of said upper housing and said lower housing, said stops being positioned so as to maintain said upper housing and said lower housing and having a predetermined force threshold necessary to be overcome to permit rotation of said upper housing relative to said lower housing from said first position to said second position.

7. The device of claim 3 further including stops located on said threads of said upper housing and said lower housing, said stops being positioned so as to maintain said upper housing and said lower housing and having a predetermined force threshold necessary to be overcome to permit rotation of said upper housing relative to said lower housing from said first position to said second position.

8. The device of claim 4 further including stops located on said threads of said upper housing and said lower housing, said stops being positioned so as to maintain said upper housing and said lower housing and having a predetermined force threshold necessary to be overcome to permit rotation of said upper housing relative to said lower housing from said first position to said second position.

9. The device of claim 1 which further includes locking means located on at least one of said upper housing and said lower housing to prevent movement from said second position to said first position after said upper housing and said lower housing have been rotated relative to one another to move from said first position to said second position.

10. The device of claim 1 which further includes an overcap attached to said upper housing and covering said spray mechanism, said overcap being removably attached to at least one of said upper housing and said lower housing.

11. The device of claim 10 wherein said overcap is attached to said upper housing and is rotatable therewith.

12. The device of claim 11 wherein said spray mechanism includes a removable, tamper-evident pull tab attached thereto such that said spray mechanism is inoperable until said pull tab has been removed,

13. The device of claim 10 wherein said upper and lower housings include external gripping means.

14. The device of claim 10, wherein said spray mechanism is a pump.

15. The device of claim 10 further including stops located on said threads of said upper housing and said lower housing, said stops being positioned so as to maintain said upper housing and said lower housing and having a predetermined force threshold necessary to be overcome to permit rotation of said upper housing relative to said lower housing from said first position to said second position.

16. The device of claim 11 wherein said upper and lower housings include external gripping means.

17. The device of claim 11, wherein said spray mechanism is a pump.

18. The device of claim 11 further including stops located on said threads of said upper housing and said lower housing, said stops being positioned so as to maintain said upper housing and said lower housing and having a predetermined force threshold necessary to be overcome to permit rotation of said upper housing relative to said lower housing from said first position to said second position.

* * * * *